United States Patent [19]

Leblanc et al.

[11] Patent Number: 4,571,161

[45] Date of Patent: Feb. 18, 1986

[54] PUMP/NOZZLE UNIT FOR FUEL INJECTION IN INTERNAL COMBUSTION ENGINES

[75] Inventors: Jean Leblanc, Lyons; Jean Pigeroulet, Villeurbanne; Francois Rossignol, Mornant, all of France

[73] Assignee: Robert Bosch GmbH, Stuttgart, Fed. Rep. of Germany

[21] Appl. No.: 714,233

[22] Filed: Mar. 21, 1985

[30] Foreign Application Priority Data

Mar. 28, 1984 [DE] Fed. Rep. of Germany ..... 3411407

[51] Int. Cl.[4] ..... F02M 47/00

[52] U.S. Cl. ..... 417/499; 123/509; 123/503; 239/88

[58] Field of Search ..... 417/490, 494, 499; 239/88, 89, 90, 91, 92, 93, 95, 96, 94; 123/358, 500, 503, 509

[56] References Cited

U.S. PATENT DOCUMENTS

| | | | |
|---|---|---|---|
| 1,981,913 | 11/1934 | Fielden | 417/494 |
| 2,144,861 | 1/1939 | Truxell, Jr. | 239/95 X |
| 2,144,862 | 1/1939 | Truxell, Jr. | 239/95 X |
| 2,831,433 | 4/1958 | Seifert et al. | 417/499 X |
| 3,190,561 | 6/1965 | Fuller et al. | 417/490 X |
| 3,336,874 | 8/1967 | Buescher et al. | 417/499 |

FOREIGN PATENT DOCUMENTS

| | | | |
|---|---|---|---|
| 1066635 | 8/1954 | France | 239/95 |

*Primary Examiner*—Leonard E. Smith
*Attorney, Agent, or Firm*—Edwin E. Greigg

[57] ABSTRACT

The pump/nozzle unit for a fuel injection system is disclosed which has a pump piston that is driven via a drive tappet and is rotatable by means of a regulating sleeve. The regulating sleeve, provided with a radially protruding control lever arm, is axially secured in its installed position by means of a guide bushing. The guide bushing includes a guide part for the drive tappet and a radially protruding flange, which is secured to the pump housing by at least one holder passing through an oblong slot on the flange of the guide bushing. A recess in the form of a circular segmented ring is cut out of the guide bushing for the passage therethrough of the control lever arm. By rotating the guide bushing within a range limited by the oblong slot a lateral limiting edge of the recess is adjustable into a position in which the pump piston, with the control lever arm resting on the limiting edge assumes a rotational position associated with a fixed supply quantity. As a result, no further additional or full-load stop device is necessary and mounting of the drive unit and pump assembly on the engine are facilitated.

9 Claims, 5 Drawing Figures

PUMP/NOZZLE UNIT FOR FUEL INJECTION IN INTERNAL COMBUSTION ENGINES

BACKGROUND OF THE INVENTION

The invention is based on a pump/nozzle unit for fuel injection systems wherein the pump piston is tappet actuated and provided with a regulating sleeve, guide bushing and control lever arm. A pump/nozzle unit of this type is already known (U.S. Pat. No. 2,144,862), in which the piston injection pump and the injection nozzle are combined in a common pump housing into a unit mounted on the cylinder head of the internal combustion engine.

To attain a change in the effective supply stroke or supply quantity, the pump piston, which is actuatable by the engine camshaft via a drive tappet counter to the force of a tappet spring and is provided with at least one oblique control edge, is rotatable by means of a regulating sleeve, disposed coaxially with it and permitting a stroke movement of the pump piston yet carrying the pump piston along with it in the direction of rotation, and by a governor rod engaging this sleeve and embodied as a supply quantity adjusting member. The regulating sleeve is inserted into a recess countersunk in the pump housing beginning at an end face on the drive side, and it is fixed in the axial direction in its installed position by a guide bushing, or by a disc secured by means of this bushing. The drive tappet is received and guided in a sleeve-like guide part of the guide bushing, which is secured in the pump housing via a threaded flange, the diameter of which is larger than that of the rest of the guide part and which is screwed into an internal thread in an enlarged part of the recess in the pump housing.

Because of the thread length necessitated for the sake of strength, and the given structural length of the tappet spring, this threaded securing of the guide bushing results in a correspondingly long structural length of the complete pump/nozzle unit. Moreover, the threaded connection of the components to one another is still incapable of preventing axial misalignments between the drive tappet and the pump piston. Furthermore, the guide bushing can be removed only after the tappet spring has been removed.

A related invention is currently pending to the same inventors under application Ser. No. 630,908, filed July 13, 1984.

OBJECTS OF THE INVENTION

It is a principal object of the present invention to provide an improved pump drive unit, comprising the guide bushing, tappet spring and drive tappet, and possibly also coupling therewith the pump piston for mounting on the pump housing, such that the regulating sleeve is made easy to install and remove and is also quickly and easily accessible.

It is a further object of the invention that the control of the supply quantity at the pump/nozzle unit take place by means of a control lever arm regulating means, in which an associated regulating sleeve is fixable, without additional stop means, into a pivoted position for mounting on the engine which is provided on the test bench.

SUMMARY OF THE INVENTION

In the pump/nozzle unit according to the invention, the guide bushing remains joined to the pump housing which carries the other components of the pump/nozzle unit even when the securing screws of the pump/nozzle unit are removed. If the regulating sleeve has to be removed or inspected, the entire unit can be removed after the holder means has been removed, without incurring additional costs for removal and mounting of this unit. Because the guide bushing is rotatable within a limited range, it can be preadjusted such that the lateral limiting edges of the recess, which is in the form of circular ring segments, set the maximum pivoting range of the control lever arm in at least one pivoting direction. No further stop means are then needed.

In a further embodiment of the pump/nozzle unit according to the invention, each pump/nozzle unit can be mounted to the engine housing with its control lever arm resting on one limiting edge and can be joined to the regulating rod linkage such that no further operations are required for balancing or adjusting the fuel supply quantity on the engine itself.

Fastening the pump/nozzle unit according to the invention with clamping shoes not only secures the holder screws of the guide bushing but also firmly holds the pump/nozzle unit in its installed position on the engine housing, and according to further features of the invention, additional means are no longer required for fixing the rotational position of the pump housing.

If the pump/nozzle unit according to the invention contains a holder means which is independent of the securing means, then the holder means need be designed with only relatively limited strength, because it merely prevents the components from coming apart; such forces as arise during operation are withstood or absorbed by the securing means, such as clamping screws or clamping shoes, which simultaneously connect the flange of the guide bushing and the securing flange of the pump housing to the engine housing.

Furthermore, no additional space is required to accommodate the holder means, if the holder means is provided in accordance with the invention as a threaded sleeve screwed into a through-bore provided for the securing screw; this through-bore has a threaded section, and the holder means thereby firmly holds the flange of the guide bushing.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
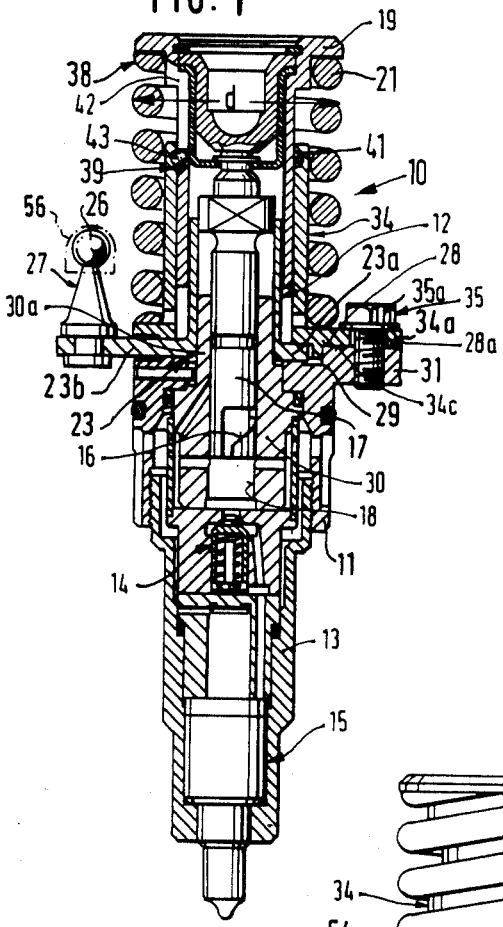
FIG. 1 is a longitudinal section, taken along the line I—I of FIG. 2, through a first embodiment of a pump/nozzle unit according to the invention, which is equipped with a control lever arm regulating means.
Figure 2:
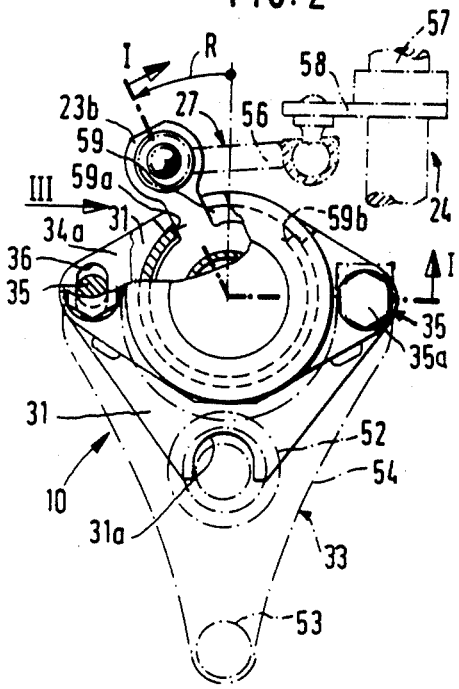
FIG. 2 is a plan view of a section in the vicinity of the control lever arm of FIG. 1.
Figure 3:
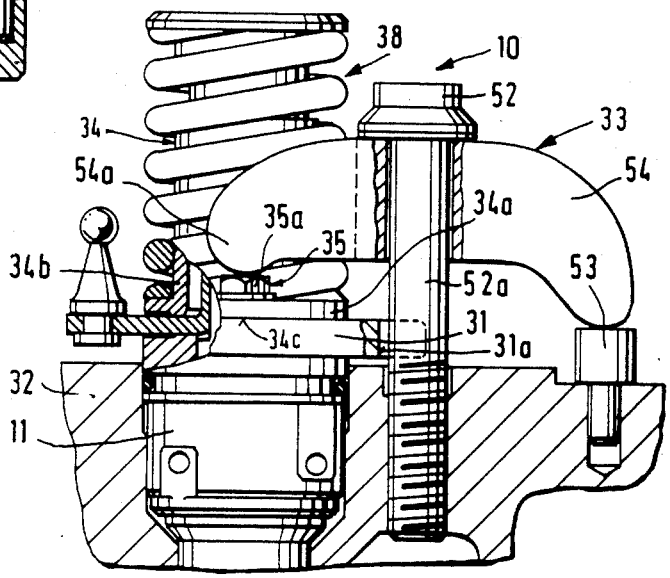
FIG. 3 is a side view of a fragmentary longitudinal section, of the first embodiment.

In the first exemplary embodiment of the pump/nozzle unit 10 according to the invention, shown in FIGS. 1–3, the pump housing 11 receives a pistson injection pump 12 and in addition includes an injection nozzle 15 secured to its end face by means of a collet 13. A pressure valve 14 is disposed between the nozzle 15 and the pump 12; the nozzle 15 is of known design and will there fore not be described in detail.

A pump piston 17 provided with an oblique control edge 16 is guided inside the pump housing 11 in a cylindrical bore 18 and is actuated in a manner known per se via drive means (not shown) driven by the engine cam shaft, via a drive tappet 19 counter to the force of a tappet spring 21, in order to attain a pump stroke in its longitudinal direction. To vary its effective supply stroke, the pump piston 17 is rotatable by means of a regulating sleeve 23 disposed coaxially with respect to it and via a control lever arm regulating means 27 which engages the regulating sleeve 23. To this end, the regulating sleeve 23 is provided with a control lever arm **23*b* protruding from an annular flange 23*a*. The control lever arm 23*b* supports a drive bolt 26**.

As best shown in FIG. 2, the control lever arm regulating means 27 is arranged for association of an actuation tongue 56 and an actuation lever 58 adjustably secured to a rotation shaft 57 so that the control lever arm **23*b* can be pivoted in order to adjust the fuel supply quantity and to adjust the attendant rotation of the pump piston 17. The rotation shaft 57 and the actuation lever 58 together comprise the supply quantity adjusting member denoted as 24**.

Referring again to FIG. 1, the pump housing 11 is provided with a countersunk recess 29 beginning at an end face 28 on the drive side, disposed coaxially with the pump piston 17 and serving to receive the regulating sleeve 23, or its annular flange **23*a*; this recess 29 surrounds an axially protruding guide neck 30*a* of a pump cylinder 30 and serves to guide the pump piston 17 and the regulating sleeve 23**.

A radially protruding securing flange 31 is located on the pump housing 11 and has the end face 28 on the drive side; securing means 33 engages this securing flange 31 in order to secure the pump/nozzle unit 10 to an internal combustion engine housing 32. In the first exemplary embodiment of the invention, the securing means 33 comprises a clamping shoe means (described in further detail below) by means of which a flange **34*a* of a guide bushing 34 is simultaneously clamped against the end face 28 of the securing flange 31, when the pump/nozzle unit 10 is mounted upon the engine housing 32. To this end, the flange 34*a*, which protrudes radially outward beyond the outside diameter d of the tappet spring 21, extends into the zone 28*a* of the end face 28 which is engaged by the securing means 33 of the pump/nozzle unit 10. The guide bushing 34 is provided with sleeve-like guide part 34*b* for the drive tappet 19 and at its end face acts as a means of axial positional fixation for the annular flange 23*a*, and thus for the regulating sleeve 23, is secured on the securing flange 31 of the pump housing 11 not only by the securing means 33 but also by two additional holder screws 35. These holder screws are not required to exert large forces, because they act merely to secure the elements while they are being transported and installed; the forces exerted during operation are absorbed by the securing means 33 proper. Even if the pump/nozzle unit 10 is disassembled or removed, or if the securing means 33 should be loosened, the end face 34*c* of the flange 34*a* is kept in contact with the end face 28 of the pump housing 11 by those holder screws 35. Once the holder screws 35 are removed, the entire drive assembly indicated as 38, comprising the drive tappet 19, the tappet spring 21 and the guide bushing 34, as well as the pump piston 17 coupled to it, can be removed as a single unit, being held together as an assembled unit by a loss-prevention means 39. The loss-prevention means 39 comprises a ball 43 disposed in an annular groove 41 in the guide part 34*b* of the guide bushing 34 and additionally guided in a longitudinal groove 42 in the drive tappet 19**.

Referring again to FIG. 1, in order to assure perfect centering of the guide bushing and prevent any axial misalignment from occuring between the pump piston 17 and the drive tappet 19, the guide bushing 34 is inserted into the recess 29 of the pump housing 11 with an arc-shaped extension **34*d* that protrudes from the end face 34*c* of its flange 34*a*. An indentation 34*e* on the end face inside this extension 34*d* and the recess 29 in the pump housing 11 together form a chamber which encompasses or surrounds the radially offstanding annular flange 23*a* of the regulating sleeve 23 on three sides and thus guides the regulating sleeve 23** in the axial direction.

Referring now to FIG. 3, the clamping shoe, already mentioned as securing means 33 of the pump/nozzle unit 10, which at least partially encompasses the drive unit 38, comprises a securing screw 52 and a clamping shoe 54 which is fixed at one end by this screw 52 against an abutment 53 on the engine housing 32 and at the other end against the holder screws 35 of the guide bushing 34. The clamping shoe 54 is provided with a forked end **54*a* the two arms of which surround the guide part 34*b* of the guide bushing in a semicircular fashion and press against heads 35*a* of the holder screws 35. These holder screws 35 are thereby simultaneously further secured to provide not only the holding force for the guide bushing 34 required for the operation of the pump/nozzle unit 10 (a holding force generated supplementary to that of the holder screws 35) but also the required securing forces necessary to reliably secure the pump housing 10 to the engine housing 32**.

A shaft **52*a* of the securing screw 52 is passed through a recess 31*a*, which serves to fix the rotational position of the pump housing 11, in the securing flange 31 of the pump housing 11. The recess 31*a* eliminates the need for further means for fixing the rotational position of the pump/nozzle unit 10** to the engine.

Referring now to FIG. 2, the two holder screws 35, which because of the securing force of the clamping shoe 54 engaging them at the top serve merely as a means for securing the drive unit 38 while it is being transported, are each screwed through an oblong slot 36 in the flange **34*a* of the guide sleeve 34 and on into the securing flange 31 of the pump housing 11. The oblong slots 36 are shaped such that the guide sleeve 34 is rotatable within a limited range. Also provided in the flange area of the guide sleeve 34 is a recess 59, in the form of a segmented ring, which enables the control lever arm 23*b* to pass therethrough. The recess 59 is provided with lateral limiting edges 59*a*, 59*b* which define the maximal pivoting range of the control lever arm 23*b* in at least one pivoting direction. This pivoting direction is indicated by an arrow R. In this view the control lever arm 23***b* rests on one limiting edge 59*a;* in this position it fixes and limits the maximum supply quantity of the pump piston 17. The limiting edge 59*a* thus serves as a full-load or starting-quantity stop.

For adjustment of the position shown in Fig. 2, the pump/nozzle unit 10 is moved to a test bench, on which, as on the engine, it is fixed in terms of its rotational position by means of a securing screw which engages the recess 31*a* and fixes the pump housing 11 in its rotational position, or by means of a fixation pin. Before the basic adjustment is made, the guide bushing 34 is rotated counterclockwise until the oblong slot 36 rests on the holder screw 35. Then the supply quantity is adjusted and the control lever arm 23*b* is restrained. The flange 34*a* of the guide bushing 34 is then rotated clockwise until the limiting edge 59*a* rests on the control lever arm 23*b*. Now the holder screws 35 are tightened and the established position is fixed. On the engine, with the control lever arm 23*b* resting on the limiting edge 59*a* and with the pump housing 11 fixed in its rotational position with respect to the engine housing 32 by means of the recess 31*a*, the control lever arm regulating means 27 is then adjusted by means of the appropriate mounting of the actuation lever 58. In this manner, all the pump/nozzle units 10 of the same engine can readily be coupled to the rotation shaft 57 of the supply quantity adjusting member 24 without any further adjustment or setting operations.

Figure 4:
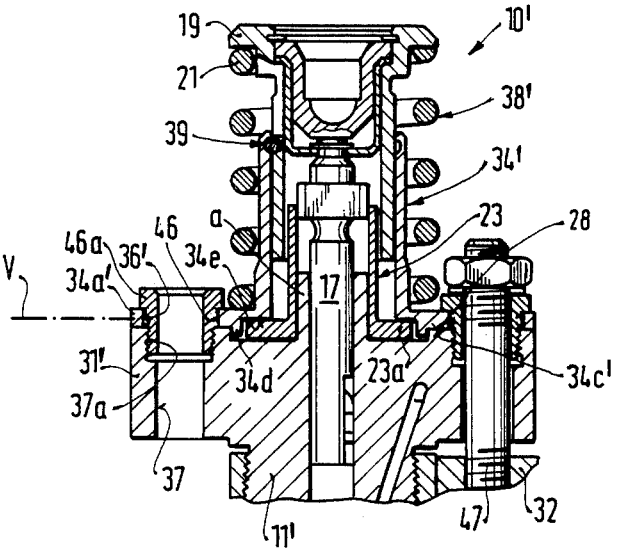
FIG. 4 is a fragmentary longitudinal section, taken along the line IV—IV of FIG. 5, showing the essential features of a second embodiment according to the invention.
Figure 5:
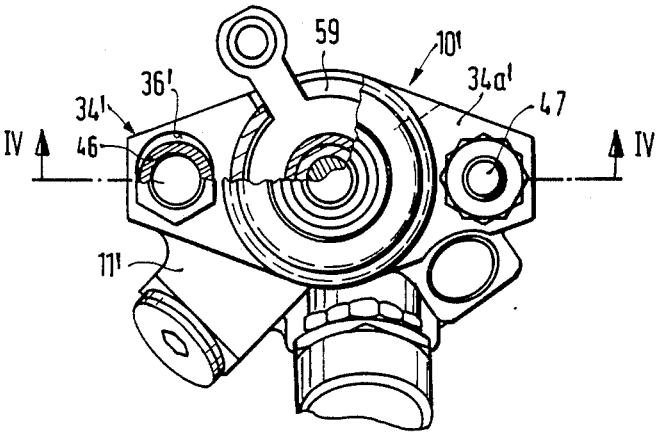
FIG. 5 is a plan view of a fragmentary section at the level of the line V in FIG. 4.

The second exemplary embodiment will hereinafter be described; it is shown in FIGS. 4 and 5 and differs from the first exemplary embodiment only in terms of the holder means for the guide bushing and in terms of different securing means. Identical elements are therefore identified by the same reference numerals; modified elements are identified by the same reference numerals provided with a prime, and new elements have new reference numerals.

In this second exemplary embodiment of a pump/nozzle unit 10', the holder means for the guide bushing 34' comprises two threaded sleeves 46, and although clamping shoes can also be used as securing means, in this example two securing screws 47, comprising stay bolts and screw nuts, are used, only one of which is shown in the drawing for the sake of clarity.

Each of the threaded sleeves 46 is provided with a radial collar 46*a;* the sleeves are disposed coaxially with the securing screw 47 and are passed through oblong slots 36' in the flange 34*a'* in respective threaded sections 37*a* of associated bores 37 of the securing flange 31'. With this collar 46*a*, the flange 34*a'* of the guide bushing 34' is secured against the end flange 28' toward the drive side on the securing flange 31' of the pump housing 11'.

As in the first exemplary embodiment, the drive unit, here marked 38' and comprising the drive tappet 19, the tappet spring 21 and the guide bushing 34', can again be removed from the pump/nozzle unit 10' as a unit, being held together by the loss-prevention means 39; this is accomplished, after the securing screws 47 are loosened or removed, by also unscrewing the threaded sleeves 46 which serve as the holder means.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A pump/nozzle unit for fuel injection in internal combustion engines comprising:

(a) a pump housing receiving a piston-type injection pump provided with an injection nozzle at one end thereof;

(b) a pump piston axially guided in a cylindrical bore in the pump housing said pump piston being rotatable by means of a regulating sleeve disposed coaxially therewith in order to vary an effective supply stroke and actuable via a drive tappet counter to force exerted by a tappet spring;

(c) a guide bushing secured on the pump housing and provided with a sleeve-like guide part for said drive tappet and an end face forming an axially positional securing means for the regulating sleeve;

(d) an extremity face being provided on the drive side on the pump housing;

(e) an actuation flange being provided on the pump housing at least indirectly engaged by securing means for securing the pump/nozzle unit to the engine;

(f) said guide bushing being provided with a bushing flange protruding radially outward beyond an outer diameter of the tappet spring, said bushing flange being provided with an end face resting on said extremity face on the drive side of the pump housing and extending into a region provided adjacent the extremity face for engagement by said securing means of the pump/nozzle unit;

(g) said bushing flange being secured on the pump housing by a holder means;

(h) said holder means for the guide bushing being arranged to pass through an oblong slot in the bushing flange of the guide bushing and be secured to a securing flange of the pump housing;

(i) said regulating sleeve being provided with a radially protruding control lever arm associated with a control lever arm regulating means;

(j) said guide bushing having a flange area in which is disposed a recess provided as a circular segmented ring in which a cutaway is provided allowing passage therethrough of said control lever arm, said recess being further provided with lateral limiting edges defining a maximum pivoting range for said control lever arm in at least one pivoting direction; and (k) said flange of said guide bushing provided with at least one oblong slot for receiving said holder means, said at least one oblong slot being arranged to allow said guide bushing to be slightly rotatable within a limited range of movement, whereby adjustment of a fuel supply quantity provided by said pump/nozzle unit is faciliated.

2. A pump/nozzle unit as defined by claim 1, further comprising said guide bushing may be adjusted into a position such that one of said limiting edges limiting the pivoting range of the control lever arm in at least one pivoting direction may be brought into engagement with said control lever arm so that at least one pump piston assumes a predetermined rotational position providing a chosen fixed fuel supply quantity.

3. A pump/nozzle unit as defined by claim 2, further wherein the securing means provided for the pump/nozzle unit comprises a clamping shoe securing means at least partially surrounding and gripping the drive section, which clamping shoe securing means comprises a clamping shoe set by securing screw against at least one holder screw securing the guide bushing.

4. A pump/nozzle unit as defined by claim 3, further comprising the securing screw of the securing means is provided with a shaft passing through a recess serving to fix a rotational position of said pump housing in the securing flange thereof.

5. A pump/nozzle unit as defined by claim 1, further comprising at least one holder screw independent of the securing means of the pump/nozzle unit serves as said holder means and joins said bushing flange of the guide bushing to the securing flange on the pump housing by passing through said at least one oblong slot in said bushing flange and into said securing flange.

6. A pump/nozzle unit as defined by claim 2, further comprising at least one holder screw independent of the securing means of the pump/nozzle unit serves as said holder means and joins said bushing flange of the guide bushing to the securing flange on the pump housing by passing through said at least one oblong slot in said bushing flange and into said securing flange.

7. A pump/nozzle unit as defined by claim 1, further comprising said securing means comprises at least two securing screws passing through oblong slots in the bushing flange of the guide bushing and on through bores provided in the securing flange.

8. A pump/nozzle unit as defined by claim 1, said holder means comprises at least one threaded annular sleeve provided with a radial collar, through which annular sleeve may be screwed coaxially a securing screw, said threaded annular sleeve being screwed through a corresponding oblong slot in the bushing flange of the guide bushing into a threaded section of an associate bore of the securing flange, so that said radial collar firmly holds the bushing flange of the guide bushing against the securing flange of the pump housing.

9. A pump/nozzle unit as defined by claim 2, said holder means comprises at least one threaded annular sleeve provided with a radial collar, through which annular sleeve may be screwed coaxially a securing screw, said threaded annular sleeve being screwed through a corresponding oblong slot in the bushing flange of the guide bushing into a threaded section of an associate bore of the securing flange, so that said radial collar firmly holds the bushing flange of the guide bushing against the securing flange of the pump housing.

* * * * *